US010617164B2

(12) United States Patent
Feumba

(10) Patent No.: US 10,617,164 B2
(45) Date of Patent: Apr. 14, 2020

(54) BREATHABLE AND WATERPROOF SWIMMING CAP SMP WIG

(71) Applicant: Francine Larissa Feumba, Middletown, DE (US)

(72) Inventor: Francine Larissa Feumba, Middletown, DE (US)

( * ) Notice: Subject to any disclaimer, the term of this patent is extended or adjusted under 35 U.S.C. 154(b) by 182 days.

(21) Appl. No.: 15/899,268

(22) Filed: Feb. 19, 2018

(65) Prior Publication Data

US 2019/0254371 A1 Aug. 22, 2019

(51) Int. Cl.
*A41G 3/00* (2006.01)
*A63B 33/00* (2006.01)

(52) U.S. Cl.
CPC ..... *A41G 3/0041* (2013.01); *A41G 3/0016* (2013.01); *A63B 33/00* (2013.01); *A41G 3/005* (2013.01); *A63B 2208/03* (2013.01); *A63B 2209/14* (2013.01)

(58) Field of Classification Search
CPC ..... A41G 3/0041; A41G 3/00; A41G 3/0016; A41G 3/005; A63B 33/00
See application file for complete search history.

(56) References Cited

U.S. PATENT DOCUMENTS

| | | | | |
|---|---|---|---|---|
| 2,242,420 | A * | 5/1941 | Di Giovanna | A42B 1/12 2/68 |
| 2009/0139044 | A1* | 6/2009 | Kwan | A46B 5/06 15/207.2 |
| 2009/0320866 | A1* | 12/2009 | Shirakashi | A41G 3/0083 132/54 |
| 2011/0186066 | A1* | 8/2011 | Twersky | A41G 3/00 132/54 |
| 2016/0255894 | A1* | 9/2016 | Kimura | D01F 6/60 |

* cited by examiner

*Primary Examiner* — Kristen Matter

(57) ABSTRACT

The present invention is an apparatus for head wear comprising a swimming cap portion that is breathable, and protects the hair and scalp of the user from water and other watery substance(s); and a wig portion that has the versatility/appearance of natural hair, and retains a desired style even after multiple use.

20 Claims, 5 Drawing Sheets

BREATHABLE AND WATERPROOF SWIMMING CAP SMP WIG

CROSS-REFERENCE TO RELATED APPLICATIONS

This application is related to U.S. Provisional Application Ser. No. 62/461,045 filed on Feb. 20, 2017, the contents of which are incorporated herein by reference.

STATEMENT REGARDING FEDERALLY SPONSORED RESEARCH OR DEVELOPMENT (IF APPLICABLE)

NOT APPLICABLE

REFERENCE TO SEQUENCE LISTING A TABLE OR A COMPUTER PROGRAM LISTING COMPACT DISC APPENDIX (IF APPLICABLE)

NOT APPLICABLE

BACKGROUND OF THE INVENTION

Several men and women have hair extensions, chemically treated hair, natural hairstyles, sewn on or glued wigs, and other hairstyles/colors that require extensive, sometimes daily maintenance.

These men/women tend to avoid water related activities in an effort to preserve the condition of the hairstyle(s) they put so much time and money into; especially since certain water related activities such as swimming (in the pool or ocean) may cause additional damage to the hair and/or hair piece due to chlorine present in pool waters or salt present in the ocean.

Though swimming caps protect the hair from water, they are rarely used because of their unappealing looks and/or because they are generally not worn outside of swimming pools.

This means that a man or woman wishing to protect his/her hairstyle while participating in a sporting event such as a triathlon (usually consisting a water event, running event, and cycling event) or a mud race or do outdoor work on a rainy day, would not be able to wear a swimming cap.

Wigs that may offer protection during some water related activities typically contains an impermeable cap that is not breathable; making long term wear of such wigs, especially during strenuous activities during which the user is sweating, unpractical. In addition, when wet, these wigs tend to lose their style, making them unsuitable for repeated or long-term use.

The present invention looks to introduce an apparatus for head wear comprising a swimming cap portion that is breathable, and protects the hair and scalp of the user from water and other watery substance(s); and a wig portion that has the versatility/appearance of natural hair, and retains a desired style even after multiple use.

BRIEF SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The subject invention discloses a breathable and waterproof swimming cap SMP wig to be used as headwear during water activities, said breathable and waterproof swimming cap SMP wig comprising: an integral breathable/waterproof swimming cap comprising a body made of a water-resistant top layer, a water-repellent middle layer, a moisture wicking bottom layer, and a watertight band, further comprising an inner surface and an outer surface, a forward edge, a rearward edge, a right edge, and a left edge defining an open lower periphery about the inner surface, wherein the open lower periphery and the inner surface are adapted to substantially conform to the top surface of the wearer's head to substantially retain the breathable/waterproof swimming cap body on the top surface of the wearer's head wherein the breathable/waterproof swimming cap body further comprises a center portion with a first thickness, and a second thickness at the forward and rearward edges, wherein the first thickness is less than the second thickness; and a wig comprising a plurality of hair strands, wherein the plurality of hair strands are adhered to the top surface of the water-resistant layer of the breathable/waterproof swimming cap body outward to the forward edge, rearward edge, right edge, and left edge, wherein the plurality of hair strands are made from shape-memory polymers that have been treated such that they will relax when wet and return to their original shape when dry, so as to mimic natural hair when wet and retain their desired style when dry.

The subject invention discloses a breathable and waterproof swimming cap SMP wig to be used as headwear during water activities, said a breathable and waterproof swimming cap SMP wig comprising: an integral breathable/waterproof swimming cap comprising a body made of a water-resistant top layer, a water-repellent middle layer, a moisture wicking bottom layer, and a watertight band, further comprising an inner surface and an outer surface, a forward edge, a rearward edge, a right edge, and a left edge defining an open lower periphery about the inner surface, wherein the open lower periphery and the inner surface are adapted to substantially conform to the top surface of the wearer's head to substantially retain the breathable/waterproof swimming cap body on the top surface of the wearer's head wherein the breathable/waterproof swimming cap body further comprises a center portion with a first stiffness, and a second stiffness at the forward and rearward edges, wherein the first stiffness is less than the second stiffness; and a wig comprising a plurality of hair strands, wherein the plurality of hair strands are adhered to the top surface of the water-resistant layer of the breathable/waterproof swimming cap body outward to the forward edge, rearward edge, right edge, and the left edge, wherein the plurality of hair strands are made from shape-memory polymers that have been treated such that they will relax when wet and return to their original shape when dry, so as to mimic natural hair when wet and retain their desired style when dry.

The subject invention further discloses a breathable and waterproof swimming cap SMP wig to be used as headwear during water activities, said breathable swimming cap wig comprising: a breathable/waterproof swimming cap comprising a body made of a water resistant top layer, a water-repellent middle layer, a moisture wicking bottom layer, and a watertight band, said breathable/waterproof swimming cap body generally hemispherical in shape with an inner surface and an outer surface further comprising a forward edge, a rearward edge, a right edge, and a left edge defining an open lower periphery about the inner surface, wherein the open lower periphery and the inner surface are adapted to substantially conform to the top surface of the wearer's head to retain the breathable/waterproof swimming cap body on the top surface of the wearer's head, wherein the breathable/waterproof swimming cap body further comprises a center portion with a first stiffness, and a second stiffness at the forward and rearward edges, wherein the first stiffness is less than the second stiffness; and a wig comprising a plurality of hair strands, wherein the plurality of hair strands are adhered to the top surface of the water-resistant layer of the breathable/waterproof swimming cap body outward to the forward edge, right edge, and the left edge, wherein the plurality of hair strands are made from shape-memory polymers that have been treated such that they will relax when wet and return to their original shape when dry, so as to mimic natural hair when wet and retain their desired style when dry.

The subject invention further discloses a breathable and waterproof swimming cap SMP wig to be used as headwear during water activities, said breathable and waterproof swimming cap SMP wig comprising: a breathable/waterproof swimming cap comprising a body made of a water resistant top layer, a water-repellent middle layer, a moisture wicking bottom layer, and a watertight band, said breathable/waterproof swimming cap body generally hemispherical in shape with an inner surface and an outer surface further comprising a forward edge, a rearward edge, a right edge, and a left edge defining an open lower periphery about the inner surface, wherein the stiffness of the breathable/waterproof swimming cap body decreases from a minimum stiffness at the center portion, to a maximum stiffness at the forward and rearward edges, and wherein the breathable/waterproof swimming cap body is held secure on the wearer's head by the watertight band; and a plurality of hair strands, each said hair strand being attached to the top surface of the water-resistant layer of the breathable/waterproof swimming cap body and extending generally outward of the outer side, wherein the plurality of hair strands are made from shape-memory polymers such that they will relax when wet and return to their original shape when dry, so as to mimic natural hair when wet and return to their desired style when dry.

In embodiments of the subject invention, the first thickness at the center portion may be a thickness no less than 0.50 mm.

In further embodiments of the subject invention, the second thickness at the forward and rearward edges may be a thickness up to 2.5 mm.

In additional embodiments of the subject invention, the swimming cap may be bonded to the plurality of hairs by sewing with a thickness no less than 2.0 mm at the sewing line in the periphery of the center portion of the swimming cap body.

In further embodiments of the subject invention, the swimming cap may be bonded to the plurality of hairs by sewing with a thickness of up to 5.0 mm at the sewing line in the periphery of the forward and rearward edges of the swimming cap body.

In other embodiments of the subject invention, the plurality of hair strands has undergone heat treatment to retain a specific shape corresponding to the user's preferred hair style; examples of shape memory polymers include polyurethane, polyethylene terephthalate (PET), polystyrene.

In further embodiments of the subject invention, the wig may be selected from the group consisting of a mesh wig and a lace-based wig.

In embodiments of the subject invention, the swimming cap may be a color selected from the group consisting of dark skin tones, medium skin tones, tanned skin tones, olive skin tones, pink skin tones, and fair skin tones.

In additional embodiments of the subject invention, the right and left edges of the breathable/waterproof swimming cap body may substantially cover the wearer's scalp and/or hair, the forward edge extends past the wearer's front hairline, and the rearward edge extends past the wearer's back hairline.

In further embodiments of the subject invention, the swimming cap may be a maximum thickness of about 5.0 mm and a minimum thickness of about 0.5 mm.

In embodiments of the subject invention, the term "substantially" is defined as at least close to (and can include) a given value or state, as understood by a person of ordinary skill in the art. In one embodiment, the term "substantially" refers to ranges within 10%, preferably within 5%, more preferably within 1%, and most preferably within 0.1% of the given value or state being specified.

In embodiments of the subject invention, the term "relatively" is defined as a comparison of a property, or the proportion of a property between two components.

There has thus been outlined, rather broadly, the more important features of the invention in order for the detailed description thereof that follows may be better understood, and in order for the present contribution to the art may be better appreciated. There are additional features of the invention that will be described hereinafter and which will form the subject matter of the claims appended hereto.

These together with other objects of the invention, along with the various features of novelty, which characterize the invention, are pointed out with particularity in the claims annexed to and forming a part of this disclosure.

DETAILED DESCRIPTION OF THE INVENTION

Figure 1A:
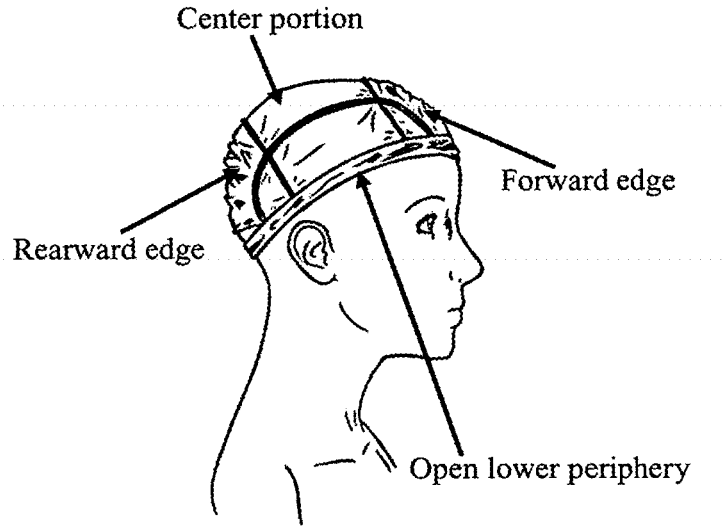
FIGS. 1A and 1B show a side view and front view, respectively, of the swimming cap body, bottom layer and watertight band.
Figure 1B:
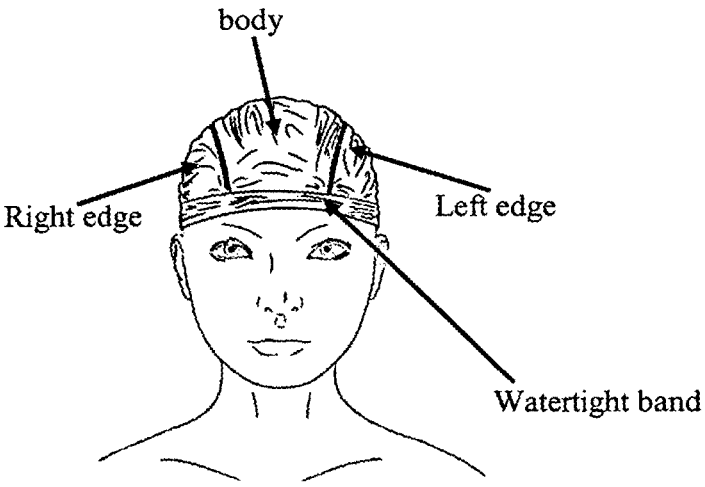
Figure 2A:
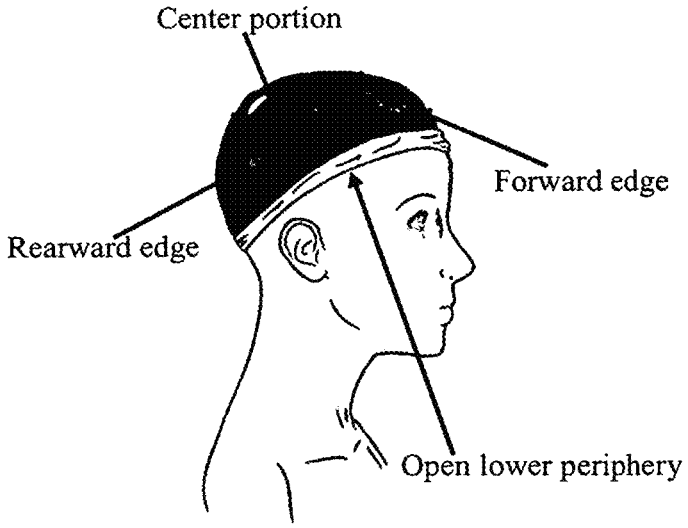
FIGS. 2A and 2B show a side view and front view, respectively, of the swimming cap body, middle layer and watertight band.
Figure 2B:
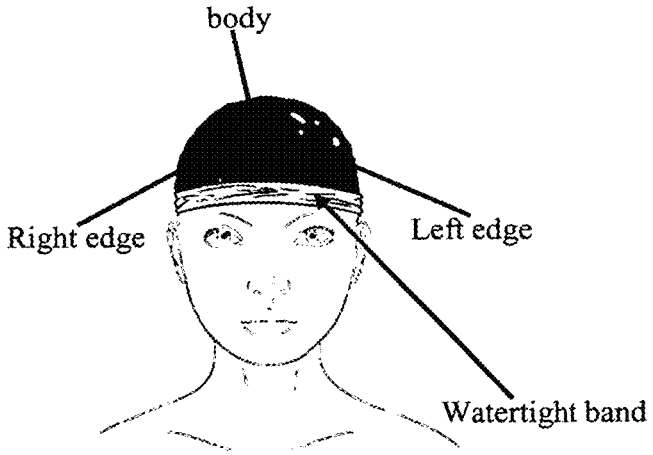
Figure 3A:
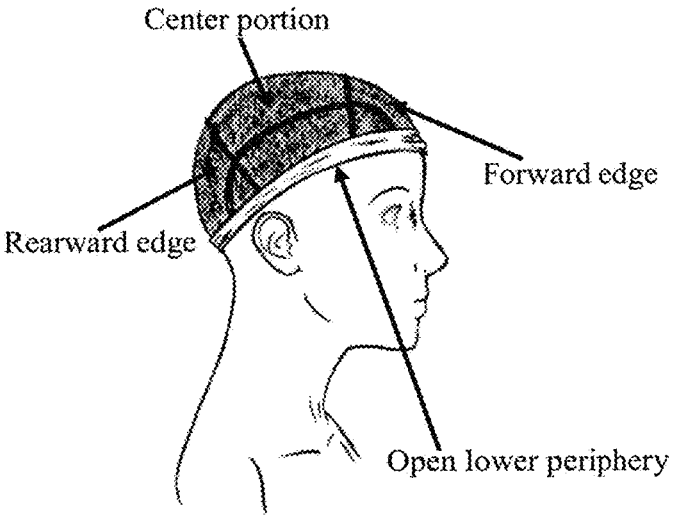
FIGS. 3A and 3B show a side view and front view, respectively, of the swimming cap body, top layer and watertight band.
Figure 3B:
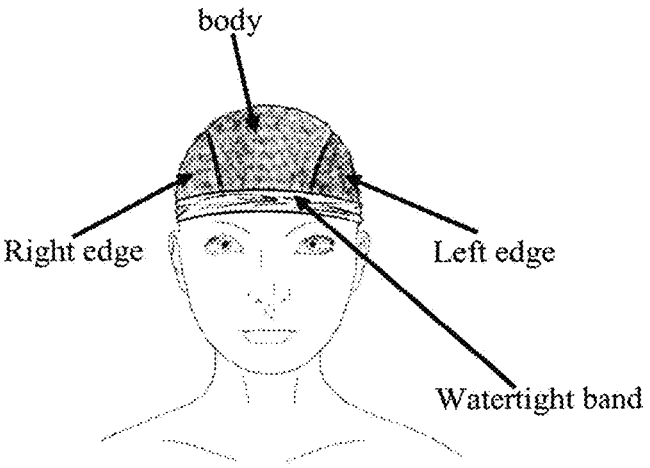
Figure 4A:
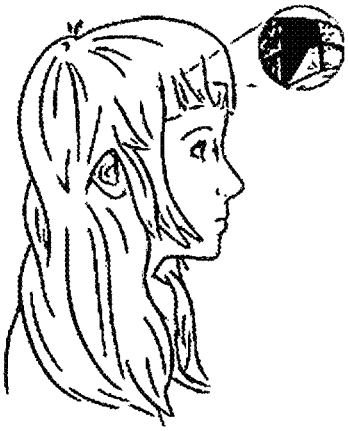
FIGS. 4A and 4B show a side view and front view, respectively, of the integral breathable and waterproof swimming cap wig of the present invention.
Figure 4B:
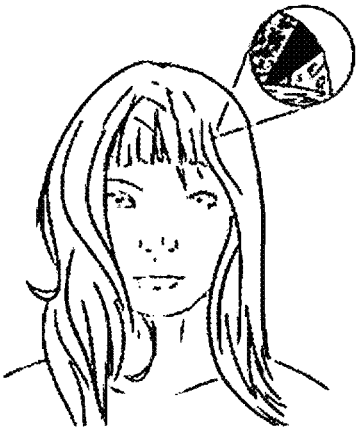
Figure 5:
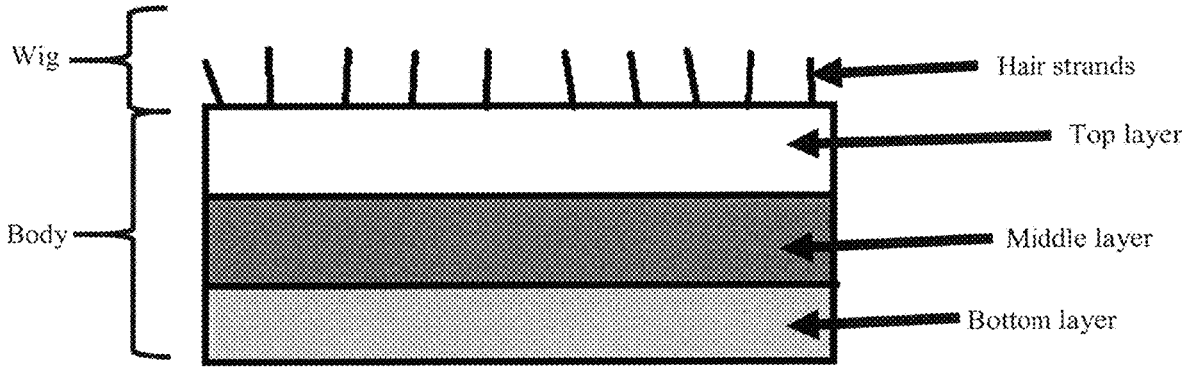
FIG. 5 shows a cross-sectional view of FIGS. 4A and 4B showing how the layers and hair stands are connected generally.

While several variations of the present invention have been illustrated by way of example in particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

The subject invention comprises a breathable and waterproof swimming cap SMP wig having an integral breathable/waterproof swimming cap body with a microporous structure that is dynamically air permeable, allowing for air exchange to help shed excess moisture vapor without compromising the waterproofness of the integral breathable/waterproof swimming cap body, shielding natural hair from water and serving as a hair protectant against chlorine in commercial and residential pools, and salt water in the oceans. The breathable and waterproof swimming cap SMP wig comprises a substantially breathable/waterproof swimming cap comprising a body made of a water resistant top layer, a water-repellent middle layer, a moisture wicking bottom layer, and a watertight band, said breathable/waterproof swimming body is attached to a wig composed of shape memory polymers. In one embodiment of the subject invention, the wig will be bonded to the cap by sewing.

In embodiments of the subject invention, the integral breathable/waterproof swimming cap body may vary in color to substantially mimic various skin colors in order to blend more naturally with a wearer's skin color. These colors may include, but are not limited to dark skin tones, medium skin tones, tanned skin tones, olive skin tones, pink skin tones, and fair skin tones.

In embodiments of the subject invention the term "wig" means an easily detachable manufactured covering of natural or synthetic hair for the head. The term "hair extension" means natural or synthetic hair which is either woven to a user's natural hair for long-term use or detachable attachment for short term use, commonly termed a weave or hair extension.

In the preferred embodiment, the hair strands of the wig from the subject invention are made from monofilament fiber with a polyethylene terephthalate (PET) composition which does not contain polyethylene and is heat resistant, has no tangling issue, reflects light much softer and thus has a more natural hair luster, wherein the wig arrives pre-styled and is capable of being curled, flat ironed and used with hot rollers with general conventional heat styling tools not to exceed 350 degrees F.

In embodiments of the subject invention, the weft of the hair weave is sewn directly unto the water-resistant layer of the integral breathable/waterproof swimming cap body. The wig comprises portions that respectively cover the top of the head, the rear, the neck area, the nape and the right and left temples. The watertight band at the edges and forehead of the wig should go past the natural hair growth lines for a watertight seal.

In embodiments of the subject invention, the integral breathable/waterproof swimming cap body is generally hemispherical in shape with an open lower periphery. In further embodiments of the subject invention, the integral breathable/waterproof swimming cap body is composed of a water-resistant top layer, a water-repellent middle layer, a moisture wicking bottom layer, and a watertight band. In the preferred embodiment, the water resistant top layer is made of monofilament, the water-repellent middle layer is made of polyurethane, the moisture wicking bottom layer (closest to the scalp) is made of a polyester and spandex mix, and the watertight band is made of a rubber material. In additional embodiments of the subject invention, the integral breathable/waterproof swimming cap body may comprise various colors.

The integral breathable/waterproof swimming cap body should have a degree of flexibility that provides a comfortable fit to the wearer. The integral breathable/waterproof swimming cap body should conform to the shape of the wearer's head and should fit securely on the wearer's head while still providing support to hold the wig hairs in place. The swimming cap should come in various sizes to accommodate head sizes from young children to adults.

A wearer dons the breathable and waterproof swimming cap SMP wig through the open lower periphery. Once in place, the integral breathable/waterproof swimming cap body substantially covers the wearer's head, extending from a forward edge at the wearer's forehead to a rearward edge at the wearer's neck past the natural hairline for a watertight seal.

The stiffness of the integral breathable/waterproof swimming cap body varies from less firm and more flexible at a center portion to more firm and less flexible along the lower portion. In embodiments of the invention, the variable stiffness is accomplished, at least in part, by varying the thickness of the integral breathable/waterproof swimming cap body, decreasing from a minimum thickness at the center portion to maximum at the edges.

In further embodiments of the invention, the integral breathable/waterproof swimming cap body has a maximum thickness of about 5.0 mm inches and a minimum thickness of about 0.5 mm.

The breathable and waterproof swimming cap SMP wig of the subject invention is assembled by sewing or hand tying hair weave extensions to the top surface of the integral breathable/waterproof swimming cap body water-resistant layer, the weave is attached from back to front covering the entirety of the water-resistant layer except for sewing lines designed to sew the different layers of the breathable/waterproof swimming cap body together; then the water-resistant layer and the wig are sewn onto the middle water-repellent layer which has been coated onto the bottom moisture wicking layer along sewing lines, leaving excess material on the lower edge of the swimming cap body; the watertight band is added by sewing a resistance band on the inner lower edge of the breathable/waterproof swimming cap body.

The many aspects and benefits of the invention are apparent from the detailed description, and thus, it is intended for the following claims to cover such aspects and benefits of the invention, which fall within the scope, and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. An integral breathable and waterproof swimming cap wig to be used as a headwear during water activities comprising: a body made of a water-resistant top layer, a water-repellent middle layer, a moisture wicking bottom layer, and a watertight band, the body further comprising: an inner surface, an outer surface, a forward edge, a rearward edge, a right edge, a left edge, an open lower periphery about the inner surface, and a center portion; wherein the open lower periphery and the inner surface are adapted to substantially conform to a top surface of a wearer's head to retain the breathable and waterproof swimming cap wig body on the top surface of the wearer's head; wherein the center portion has a first thickness; and the forward and rearward edges have a second thickness, the first thickness being less than the second thickness; and a wig comprising a plurality of hair strands made from shape-memory polymers that have been treated such that the plurality of hair strands will relax when wet and return to an original shape when dry, so as to mimic natural hair when wet and retain a desired style when dry; wherein the plurality of hair strands are adhered to a top surface of the water-resistant top layer of the body and extend outward from the forward edge, the right edge, the left edge, and the rearward edge.

2. The integral breathable and waterproof swimming cap wig of claim 1, wherein the first thickness comprises a thickness of 0.5 mm.

3. The integral breathable and waterproof swimming cap wig of claim 1, wherein the second thickness comprises a thickness of 2.0 mm.

4. The integral breathable and waterproof swimming cap wig of claim 1, wherein the body is bonded to the plurality of hair strands through sewing.

5. The integral breathable and waterproof swimming cap wig of claim 1, wherein the shape memory polymers are selected from the group consisting of: polyurethane, polyethylene terephthalate (PET), and polystyrene.

6. The integral breathable and waterproof swimming cap wig of claim 1, wherein the wig is selected from a group consisting of a mesh wig and a lace-based wig.

7. The integral breathable and waterproof swimming cap wig of claim 1, wherein the body comprises a color selected from the group consisting of dark skin tones, medium skin tones, tanned skin tones, olive skin tones, pink skin tones, and fair skin tones.

8. The integral breathable and waterproof swimming cap wig of claim 1, wherein the forward, rearward, right and left edges of the body are configured to cover the wearer's scalp and/or hair such that the forward edge extends past the wearer's front hairline and the rearward edge extends past the wearer's back hairline.

9. An integral breathable and waterproof swimming cap wig to be used as a headwear during water activities comprising: a body made of a water resistant top layer, a water-repellent middle layer, a moisture wicking bottom layer, and a watertight band, the body further comprising: an inner surface, an outer surface, a forward edge, a rearward edge, a right edge, a left edge, an open lower periphery about the inner surface, and a center portion; wherein the open lower periphery and the inner surface are adapted to substantially conform to a top surface of a wearer's head to retain the breathable and waterproof swimming cap wig body on the top surface of the wearer's head; wherein the center portion has a first stiffness and the forward and rearward edges have a second stiffness, the first stiffness being less than the second stiffness; and a wig, comprising a plurality of hair strands made from shape-memory polymers that have been treated such that the plurality of hair strands will relax when wet and return to an original shape when dry, so as to mimic natural hair when wet and retain a desired style when dry; wherein the plurality of hair strands are adhered to a top surface of the water-resistant top layer of the body and extend outward from the forward edge, the right edge, the left edge, the the rearward edge.

10. The integral breathable and waterproof swimming cap wig of claim 9, wherein the body is bonded to a plurality of hair strands through sewing.

11. The integral breathable and waterproof swimming cap wig of claim 2, wherein the shape memory polymers are selected from the group consisting of: polyurethane, polyethylene terephthalate (PET), and polystyrene.

12. The integral breathable and waterproof swimming cap wig of claim 9, wherein the wig is selected from a group consisting of a mesh wig and a lace-based wig.

13. The integral breathable and waterproof swimming cap wig of claim 9, wherein the body comprises a color selected from the group consisting of dark skin tones, medium skin tones, tanned skin tones, olive skin tones, pink skin tones, and fair skin tones.

14. The integral breathable and waterproof swimming cap wig of claim 9, wherein the forward, rearward, right and left edges of the body are configured to cover the wearer's scalp and/or hair such that the forward edge extends past the wearer's front hairline and the rearward edge extends past the wearer's back hairline.

15. An integral breathable and waterproof swimming cap wig to be used as a headwear during water activities comprising: a body, generally hemispherical in shape, made of a water resistant top layer, a water-repellent middle layer, a moisture wicking bottom layer, and a watertight band, the body further comprising: an inner surface, an outer surface, a forward edge, a rearward edge, a right edge, a left edge, an open lower periphery about the inner surface, and a center portion; wherein the open lower periphery and the inner surface are adapted to substantially conform to a top surface of a wearer's head to retain the body on the top surface of the wearer's head; wherein the center portion has a first stiffness, and the forward and rearward edges have a second stiffness, the first stiffness being less than the second stiffness; and a wig, comprising a plurality of hair strands made from shape-memory polymers that have been treated such that the plurality of hair strands will relax when wet and return to an original shape when dry, so as to mimic natural hair when wet and retain a desired style when dry; wherein the plurality of hair strands are adhered to a top surface of the water-resistant top layer of the body and extend outward from the forward edge, the right edge, the left edge, and the rearward edge.

16. The integral breathable and waterproof swimming cap wig of claim 15, wherein the body is bonded to the plurality of hair strands through sewing.

17. The integral breathable and waterproof swimming cap wig of claim 15, wherein the shape memory polymers selected are from the group consisting of: polyurethane, polyethylene terephthalate (PET), and polystyrene.

18. The integral breathable and waterproof swimming cap wig 15, wherein the wig is selected from a group consisting of a mesh wig and a lace-based wig.

19. The integral breathable and waterproof swimming cap wig of claim 15, wherein the body comprises a color selected from the group consisting of dark skin tones, medium skin tones, tanned skin tones, olive skin tones, pink skin tones, and fair skin tones.

20. The integral breathable and waterproof swimming cap wig of claim 15, wherein the forward, rearward, right and left edges of the integral breathable and waterproof swimming cap body are configured to cover the wearer's scalp and/or hair; such that the forward edge extends past the wearer's front hairline; and the rearward edge extends past the wearer's back hairline.

* * * * *